US006423181B1

(12) United States Patent
Mendez-Gallon et al.

(10) Patent No.: US 6,423,181 B1
(45) Date of Patent: Jul. 23, 2002

(54) GRAVURE PAPER AND MANUFACTURING PROCESS FOR THIS PAPER

(75) Inventors: Benjamin Mendez-Gallon, Königsbronn; Klaus Prechtel, Heidenheim; Wolfram Sturm, Heidenheim; Johann Moser, Heidenheim; Volker Schmidt-Rohr, Heidenheim; Ingolf Cedra, Heidenheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/571,744

(22) Filed: May 15, 2000

(30) Foreign Application Priority Data

May 14, 1999 (DE) ..... 199 22 390

(51) Int. Cl.[7] ..... D21H 19/52; D21H 23/28; D21H 27/38

(52) U.S. Cl. ..... 162/128; 162/185; 162/186

(58) Field of Search ..... 162/112, 123, 162/124, 125, 128, 135, 136, 137, 145, 158, 181.1, 181.8, 183, 184, 186, 187

(56) References Cited

U.S. PATENT DOCUMENTS

| | | | | | |
|---|---|---|---|---|---|
| 2,060,824 | A | * | 11/1936 | Rafton | 162/128 |
| 2,168,560 | A | * | 8/1939 | Charlton | 162/128 |
| 4,008,121 | A | * | 2/1977 | Coleman | 162/124 |
| 4,298,652 | A | * | 11/1981 | Suzuki et al. | 428/323 |
| 4,309,248 | A | * | 1/1982 | Hou et al. | 162/149 |
| 4,861,427 | A | * | 8/1989 | Johnson et al. | 162/129 |
| 5,039,378 | A | * | 8/1991 | Pommier et al. | 162/128 |
| 5,180,624 | A | | 1/1993 | Kojima et al. | 428/211 |
| 5,667,900 | A | | 9/1997 | Kato et al. | 428/474.7 |
| 5,753,078 | A | | 5/1998 | Koutitonsky et al. | 162/135 |
| 5,830,317 | A | * | 11/1998 | Vinson et al. | 162/125 |

FOREIGN PATENT DOCUMENTS

| | | | |
|---|---|---|---|
| DE | 820851 | 11/1951 | |
| DE | 1942348 | 3/1971 | D21F/1/02 |
| DE | 19624127 | 12/1997 | D21F/1/02 |
| EP | 0651092 | 5/1995 | D21F/9/00 |
| EP | 0745721 | 12/1996 | D21F/1/02 |
| WO | 84/01176 | 3/1984 | D21H/5/00 |
| WO | 97/29238 | 8/1997 | D21H/23/28 |

OTHER PUBLICATIONS

English Language Abstract of DE 196 24 127.

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

A gravure paper and a method of manufacturing gravure paper having a maximal roughness depth of approximately 1.40 $\mu$m. The method utilizes a paper machine including a forming system, a first press section, and a drying section, and includes producing a stock suspension including a stock having a freeness of greater than or equal to approximately 50 ml CSF, forming an unfinished fibrous material web from the stock suspension, and applying at least one of a pigment and a filler slurry to the unfinished fibrous material web between a beginning of the forming system and a position at which the dry matter content of the unfinished fibrous material web is approximately $\leqq$90%.

51 Claims, 3 Drawing Sheets

GRAVURE PAPER AND MANUFACTURING PROCESS FOR THIS PAPER

CROSS-REFERENCE TO RELATED APPLICATIONS

The present application claims priority under 35 U.S.C. §119 of German Patent Application No. 199 22 390.4, filed on May 14, 1999, the disclosure of which is expressly incorporated by reference herein in its entirety.

BACKGROUND OF THE INVENTION

1. Field of the Invention

The invention relates to a manufacturing process for a gravure paper with a maximal roughness depth of approximately 1.40 μm (measured with the "Parker Print Surf" method according to DIN-ISO 8791-4). The invention also relates to a gravure paper which is manufactured in a single work cycle.

2. Discussion of Background Information

Different printing processes are known from the prior art which place different demands on the quality and properties of the paper to be printed in order to achieve an optimal printing quality. In the gravure process, it is particularly crucial that the surface of the paper used is very smooth or has a very low roughness depth so that a sufficient printing quality is achieved, Furthermore, the porosity must be low in order to assure an optimal color absorption. In order to achieve the best printing quality, the sheet must also have a certain compressibility after being subjected to calendering.

In addition to the low roughness depth, however, a high tensile strength is also required in order to prevent tearing of the paper web during the printing process.

In order to produce a very high surface quality, i.e., a low roughness depth of the paper, the filler content or the pigment content of the fibrous material suspension must be kept as high as possible. This is because these very fine materials produce a very smooth and homogeneous surface of the paper. In addition. a fibrous material is used which has as high a beating degree as possible in order to produce a homogeneous sheet texture by utilizing the high content of fines. The uniformity and closed nature of the paper surface are of particular significance.

However, a high filler content runs counter to the requirement for a high strength of the paper. In order to achieve a high tear strength, an excessive filler content is not desirable since the filler acts as an obstacle to the hydrogen bridge formation between the fibers of the paper. In addition, a high beating degree impairs the strength due to a fiber-shortening effect.

Currently, in order to circumvent these opposing interests, gravure paper is in part manufactured so that coating-base paper is produced as a highly tear-resistant paper whose surface is coated with pigment and filler material in order to obtain a sufficient surface quality. However, this requires a high investment outlay because, in addition to the paper machine required for producing the paper, an investment must also be made in a coating machine, which may function either on-line or off-line in relation to the paper manufacturing process.

If one pursues the other possibility of keeping the beating degree of the paper as high as possible, i.e., in the vicinity less than approximately 40 ml CSF (Canadian Standard Freeness, see TAPI 227), and working with a relatively high total filler content, then this involves a powerful beating of the fibrous material. However, this is very energy intensive since the energy used rises exponentially as the beating degree increases.

The beating degree of fibrous material is frequently expressed in milliliters as Canadian Standard Freeness (CSF). In this connection, a high beating degree, i.e., a high fineness of the fibrous material or a high drainage resistance, corresponds to a low CSF value, whereas a lower beating degree corresponds to a high CSF value or a low drainage resistance.

The Applicant's German Patent Application 196 24 127 A1, the disclosure of which is expressly incorporated by reference in its entirety, discloses a process for manufacturing a paper web with the aid of a multi-layer headbox. With this process for manufacturing a multi-layer fibrous material web, a headbox supplies a number of fibrous suspension streams to a web forming device in which, in order to produce a three-layer fibrous material web, the two outer layers are produced by utilizing two fibrous suspension streams whose composition is selected so that each outer layer is subsequently easier to drain than the inner layer, which is produced by providing a fibrous suspension stream with a correspondingly different composition. However, the specific information relating to the composition of the individual fibrous suspension flows is not given in this document.

Furthermore, the international application PCT/US97/01975 has disclosed applying uncooked starch to the surface of a fibrous material web which is still wet. This is performed in the vicinity of the wet section of a paper machine in order to improve the surface of the paper. However, no indication is given in this document as to the manufacture of a gravure paper.

SUMMARY OF THE INVENTION

The invention is therefore provides for a manufacturing process for gravure papers which is distinguished by a significantly more favorable energy expense and fibrous material utilization as well as a lower investment requirement than is customary in the prior art, The invention also provides for a gravure paper which, as a result of its manufacturing process, is less expensive to produce than in the prior art.

The invention recognizes that it is possible to produce a gravure paper by using a fibrous material that has a low beating degree with values of greater than approximately 50 ml CSF, preferably between approximately 50 ml and approximately 120 ml CSF, without having to use a coating machine in either an "on-line" or "off-line" operation. Moreover, it is possible to situate the majority of the filler or pigment content of the finished paper web in the immediate vicinity of the surface of the finished paper web, such that, on the one hand, the tear strength of the gravure paper produced is increased and, on the other hand, the maximal surface roughness depth of the paper is not impaired. At the same time, however, the manufacturing process also takes place in one work cycle. In this connection, it is important for the dry matter content of the fibrous material web on which the filler and/or the pigment is deposited to be approximately ≦90%, preferably between approximately 3% to approximately 55%, and most preferably between approximately 5% to approximately 20%, since only in this way can a favorable bonding of the filler or the pigment to the fibrous material web be achieved.

With a constant basis weight, a high total filler content requires a lower relative content of strength-inducing fibrous material components. As a result, it is necessary to use higher quality and therefore more expensive fibrous material components. This disadvantage is prevented through the invention by the deliberate application of pigments to the surface of the paper. Consequently, more reasonably priced fibrous materials can be used without loss of quality.

According to one aspect of the invention, there is provided a process for manufacturing gravure paper with a maximal roughness depth of approximately 1.40 $\mu$m which includes producing a stock suspension that has a stock with a freeness (i.e., measure for the beating degree) of greater than or equal to approximately 50 ml CSF (i.e., Canadian Standard Freeness), preferably between approximately 50 ml to approximately 120 ml CSF, and most preferably between approximately 50 ml to approximately 80 ml CSF, producing a fibrous material web using this stock suspension with the aid of a forming system, a first press section, and a drying section, applying at least one pigment and/or filler slurry to the unfinished fibrous material web in the vicinity between the beginning of the forming and a position at which a dry matter content of the fibrous material web is approximately $\leqq$90%, and preferably between approximately 3% and approximately 50%, with the fibrous material content in the pigment and/or filler slurry preferably lying in the range from approximately 2% to approximately 60%, and preferably between approximately 5% to approximately 30%, such that no subsequent coating of the paper web is required.

This advantageously provides that the filler content is essentially concentrated in the layers that are close to the surface or that constitute the surface, since these layers are important for printing. This also allows for a low filler content in the center of the sheet, which contributes to the favorable tear strength of the paper, such that, by utilizing the additional reduction of the beating degree in comparison to the prior art to a beating degree of greater than approximately 50 ml CSF, an increase in the tear strength of the paper is also achieved. This also leads to the web attaining better runability through the paper machine and thereafter also through a printing machine.

An advantageous embodiment of the manufacturing process provides that after the at least one application of pigment and/or filler slurry, a passage through a press occurs. This passage through a press increases the bonding of the pigment and/or the filler coating to the fibrous material web.

According to the invention, the manufacturing process can be used on one side of the fibrous material web as well as on both sides of the fibrous material web so that the pigment and/or filler slurry can also be deposited on both sides of the fibrous material web.

There are a number of possible locations for the application of the pigment and/or filler slurry layer. These can include, for example, the forming system of the paper machine or the press section.

Because of the composition of the pigment and/or filler slurry, there is also the possibility of applying this to the fibrous material web through a wire. This advantageously allows the coating to be applied to the paper web at a time at which the tear strength of the paper web itself is not yet sufficient to remove it from the wire. Even if this were possible, the coating process would have a straining action on the fiber structure and would impair the later tear strength of the paper web. The application of the pigment and/or filler slurry can also take place through a wire and onto a paper web which is already relatively tear-resistant in order to reduce the potential of a possible web tear in the manufacturing process and therefore in order to increase the effective running time of the paper machine.

Advantageous values for the total coating weight of the at least one coating of the pigment and/or filler slurry on each side of the paper web is a moisture-free weight of from approximately 0.5 to approximately 10.0 g/m$^2$, and preferably from approximately 1.0 to approximately 10 g/m$^2$.

The manufacturing process is not solely limited to the application of a filler and/or pigment slurry to an already existing fibrous material web, but the gravure paper can also be produced according to the invention with a maximal surface roughness depth of approximately 1.40 $\mu$m by virtue of the fact that a stock suspension is produced which has a fibrous material with a freeness (i.e., measure for the beating degree) of greater than or equal to approximately 50 ml CSF, preferably between approximately 50 ml to approximately 120 ml CSF, and most preferably between approximately 50 ml to approximately 80 ml CSF, simultaneously a filler and/or pigment suspension is produced, with the fibrous material/fines content in the pigment and/or filler suspension preferably lying in the range of between approximately 10% to approximately 95%, and preferably between approximately 30% to approximately 60%. Then, a fibrous material web is formed with the aid of a headbox which has at least two, and preferably at least three layers, with at least one layer, and preferably the two outer layers, being loaded with the filler and/or pigment suspension and at least one layer, preferably the inner layer, being loaded with the stock suspension described above. Then comes the formation of a paper web with the aid of a forming system, a press section, and a drying section, such that no subsequent coating of the paper web is required.

This process according to the invention also achieves the fact that in the outer layer to be printed or in the two outer layers, there is a very high filler and/or pigment content while, in the one fiber-containing layer, or in the inner layer, there are fibers with a relatively low beating degree that corresponds to greater than approximately 50 ml CSF, and preferably in the range from approximately 50 ml to approximately 100 ml CSF, so that a very favorable tear strength of the paper web is assured here.

For example, the following can be used as pigment or filler: kaolin, clay, powdered $CaCO_3$, PCC (i.e., precipitated $CaCO_3$), $TiO_2$, talcum, bentonite.

In addition to these fillers or pigments, at least one of the following substances can be added: retention agents, dispersion agents, fixing agents, sizing agents, bonding agents, and starch. In addition, fines suspension can also be used.

Furthermore, the invention provides for a gravure paper with a surface roughness depth of approximately 1.40 $\mu$m, which is manufactured by the following manufacturing process: producing a stock suspension that has a stock with a freeness of greater than or equal to approximately 50 ml CSF, preferably between approximately 50 ml to approximately 120 ml CSF, and most preferably between approximately 50 ml to approximately 80 ml CSF, producing a fibrous material web using this stock suspension with the aid of a forming system, a first press section, and a drying section, applying a pigment and/or filler slurry to the unfinished fibrous material web in the vicinity between the beginning of the forming and a position at which a dry matter content of the fibrous material web is approximately $\leqq$90%, and preferably between approximately 5% and approximately 20% on at least one side of the web, with the fibrous material content in the pigment and/or filler slurry preferably lying in the range from approximately 2% to approximately 60%, and preferably between approximately 5% to approximately 30%, such that no subsequent coating of the paper web is required.

On the one hand, gravure paper manufactured in this way fulfills the requirement for a very favorable printability by utilizing the high filler content in at least one or also in both of the outer layers, and on the other hand, has a very closed, homogeneous, and flat surface. Furthermore, the runability of such a gravure paper is advantageously improved to a significant degree, such that, at the same time, due to the low beating degree required, a considerable energy savings is achieved in the manufacture of the stock used and therefore of the fibrous suspension. The gravure paper has particularly favorable properties if, after the application of the pigment and/or filler slurry onto the unfinished web, a passage through a press occurs, since a high degree of bonding of the pigment and/or filler layer to the fibrous material web is achieved thereby.

According to the invention, the gravure paper can be manufactured by virtue of the fact that the application of the pigment and/or filler slurry takes place in the forming system of the paper machine or in the press section of the paper machine.

The application of pigment and/or filler slurry onto the unfinished fibrous material web can also take place through a wire.

Advantageously, the total coating weight of the pigment and/or filler slurry on one side is from approximately 0.5 to approximately 10.0 g/m$^2$, and preferably from approximately 1.0 to approximately 10 g/m$^2$ in moisture-free weight.

The invention also proposes a gravure paper which has a surface roughness depth of approximately 1.40 $\mu$m, which has been produced using the following manufacturing process; producing a stock suspension that has a stock with a freeness of greater than or equal to approximately 50 ml CSF, preferably between approximately 50 ml to approximately 120 ml CSF, and most preferably between approximately 50 ml to approximately 80 ml CSF, producing a filler and/or pigment suspension, with the fibrous material/fines content in the pigment and/or filler suspension preferably lying in the range from approximately 2% to approximately 60%, and preferably between approximately 5% to approximately 30%, producing a fibrous material web with the aid of a headbox that has at least two, preferably at least three layers, with one layer, preferably the two outer layers, being loaded with the pigment suspension and at least one layer, preferably the inner layer, being loaded with the stock suspension mentioned above, subsequently forming a paper web with the aid of a forming system, a press section, and a drying section, such that a subsequent coating of the paper web is not required.

The advantage of a gravure paper produced in this manner lies essentially in the extraordinarily more favorable energy requirement in the manufacture of the fibrous material suspension and an outstanding printability of the paper surface due to its high filler content. Since the investment in an additional coating machine can be eliminated, this is a very cost-effective manufacturing possibility.

With both the latter and the former gravure paper, at least one of the following substances can be used as pigment or filler. kaolin, clay, powdered $CaCO_3$1 PCC, TiO2 talcum, or bentonite. In addition, chemical supplementary agents, in particular bonding agents, can also be added in order to further improve the paper surface produced. Additional fines-containing suspension can also be added in order to increase the bonding forces.

The features of the invention which are mentioned above and to be explained below can be used not only in the combinations indicated, but also in other combinations or by themselves without departing the scope of the invention.

Additional features and advantages of the invention can be found in the following description of preferred exemplary embodiments with reference to the drawings.

According to one aspect of the invention, there is provided a method of manufacturing gravure paper having a maximal roughness depth of approximately 1.40 $\mu$m in a paper machine comprising a forming system, a first press section, and a drying section, the method comprising producing a stock suspension comprising a stock having a freeness of greater than or equal to approximately 50 ml CSF, forming an unfinished fibrous material web from the stock suspension, and applying at least one of a pigment and a filler slurry to the unfinished fibrous material web between a beginning of the forming system and a position at which the dry matter content of the unfinished fibrous material web is approximately $\leqq$90%. The stock suspension may comprise a stock having a freeness of between approximately 50 ml to approximately 120 ml CSF. The stock suspension may comprise a stock having a freeness of between approximately 50 ml to approximately 80 ml CSF. After the applying of the at least one of the pigment and the filler, no subsequent coating may occur. A fibrous material content in at least one of the pigment and the filler slurry may be in the range of between approximately 2% to approximately 60%. The fibrous material content in the at least one of the pigment and the filler slurry may be in the range of between approximately 5% to approximately 30%. The gravure paper may be manufactured without utilizing coating which does not occur in at least one of the forming system, the press section, and the drying section. The applying may occur before the unfinished fibrous material web passes through the press section of the paper machine. The applying may occur before the unfinished fibrous material web passes through the press section and the drying section of the paper machine. The applying may further comprise applying at least one of the pigment and the filler on both sides of the unfinished fibrous material web.

The applying may occur in the forming system of the paper machine. The applying of the at least one of the pigment and the filler slurry to the unfinished fibrous material web may occur in the press section of the paper machine. The applying may occur when the unfinished fibrous material web has a dry matter content of less than approximately 55% The applying may occur when the dry matter content is between approximately 3% to approximately 55%. The applying may be performed through a wire.

A total coating weight of at least one application of one of the at least one of the pigment and the filler slurry on one side of the unfinished fibrous material web may comprise a moisture-free weight of between approximately 0.5 to approximately 10.0 g/m$^2$. The moisture-free weight may be between approximately 1.0 to approximately 10 g/m$^2$.

The invention also provides for a method of manufacturing gravure paper having a maximal roughness depth of approximately 1.40 $\mu$m in a paper machine comprising a forming system having a headbox, a first press section, and a drying section, the method comprising producing a stock suspension comprising a stock having a freeness of greater than or equal to approximately 50 ml CSF, producing a coating suspension comprising at least one of a filler and a pigment, the coating suspension having a fiber content in the range of between approximately 10% to approximately 95%, forming a fibrous material web comprising at least two layers with the headbox, wherein at least one layer is formed from the coating suspension and another layer is formed from the stock suspension, and forming a paper web by guiding the fibrous material web through the forming system, the first press section, and the drying section. The stock suspension may comprise a stock having a freeness of between approximately 50 ml to approximately 120 ml CSF. The stock suspension may comprise a stock having a freeness of between approximately 50 ml to approximately 80 ml CSF. The fiber content may be in the range of between approximately 20% to approximately 60%. The at least one of the pigment and the filler may comprise at least one of kaolin, clay, powdered $CaCO_3$, PCC, $TiO_2$, talcum, and bentonite. The at least one of the pigment and the filler may comprise at least one of retention agents, fixing agents, dispersion agents, sizing agents, bonding agents, and fines suspension, The at least one of the pigment and the filler may comprise at least one of retention agents, fixing agents, dispersion agents, sizing agents, bonding agents, and fines suspension.

The invention also provides for a gravure paper having a maximal surface roughness depth of 1.40 $\mu$m which is made in a paper machine comprising a forming system, a first press section, and a drying section by a method comprising producing a stock suspension comprising a stock having a freeness of greater than or equal to approximately 50 ml CSF, forming an unfinished fibrous material web from the stock suspension, and applying at least one of a pigment and a filler slurry to the unfinished fibrous material web between a beginning of the forming system and a position at which the dry matter content of the unfinished fibrous material web is approximately 90%. The stock suspension may comprise a stock having a freeness of between approximately 50 ml to approximately 120 ml CSF. The stock suspension may comprise a stock having a freeness of between approximately 50 ml to approximately 80 ml CSF. After the applying of the at least one of the pigment and the filler, no subsequent coating may occur. A fibrous material content in the at least one of the pigment and the filler slurry may be in the range of between approximately 2% to approximately 60%. The fibrous material content in the at least one of the pigment and the filler slurry may be in the range of between approximately 5% to approximately 30%. The gravure paper may be manufactured without utilizing coating which does not occur in at least one of the forming system, the press section, and the drying section. The applying may further comprise applying at least one of the pigment and the filler on both sides of the unfinished fibrous material web.

The applying may occur before the unfinished fibrous material web passes through the press section of the paper machine. The applying may occur before the unfinished fibrous material web passes through the press section and the drying section of the paper machine. The applying may further comprise simultaneously applying at least one of the pigment and the filler on both sides of the unfinished fibrous material web. The applying may occur in the forming system of the paper machine. The applying of the at least one of the pigment and the filler slurry to the unfinished fibrous material web may occur in the press section of the paper machine. The applying may occur when the unfinished fibrous material web has a dry matter content of less than approximately 55%. The applying may be performed through a wire.

A total coating weight of at least one application of one of the at least one of the pigment and the filler slurry on one side of the unfinished fibrous material web may comprises a moisture-free weight of between approximately 0.5 to approximately 10.0 g/m$^2$. The moisture-free weight may be between approximately 1.0 to approximately 10.0 g/m$^2$.

The invention also includes a gravure paper having a maximal surface roughness depth of 1.40 $\mu$m which is made in a paper machine comprising a forming system having a headbox, a first press section, and a drying section by a method comprising producing a stock suspension comprising a stock having a freeness of greater than or equal to approximately 50 ml CSF, producing a coating suspension comprising at least one of a filler and a pigment, the coating suspension having a fiber content in the range of between approximately 2% to approximately 60%, forming a fibrous material web comprising at least two layers with the headbox, wherein at least one layer is formed from the coating suspension and another layer is formed from the stock suspension, and forming a paper web by guiding the fibrous material web through the forming system, the first press section, and the drying section, The stock suspension may comprises a stock having a freeness of between approximately 50 ml to approximately 120 ml CSF. The stock suspension may comprise a stock having a freeness of between approximately 50 ml to approximately 80 ml CSF. The fiber content may be in the range of between approximately 5% to approximately 30%. The at least one of the pigment and the filler may comprises at least one of kaolin, clay, powdered $CaCO_3$, PCC, $TiO_2$, talcum, and bentonite. The at least one of the pigment and the filler may comprise at least one of retention agents, fixing agents, dispersion agents, sizing agents, bonding agents, and fines suspension. The at least one of the pigment and the filler may comprise at least one of retention agents, fixing agents, dispersion agents, sizing agents, bonding agents, and fines suspension. The coating suspension may comprises a stock having a freeness degree of approximately $\leqq$30 ml CSF. The freeness degree may be approximately $\leqq$20 ml CSF. The fiber content of the coating suspension may be between approximately 50% to approximately 100% less than a fiber content of the stock suspension.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most usefull and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
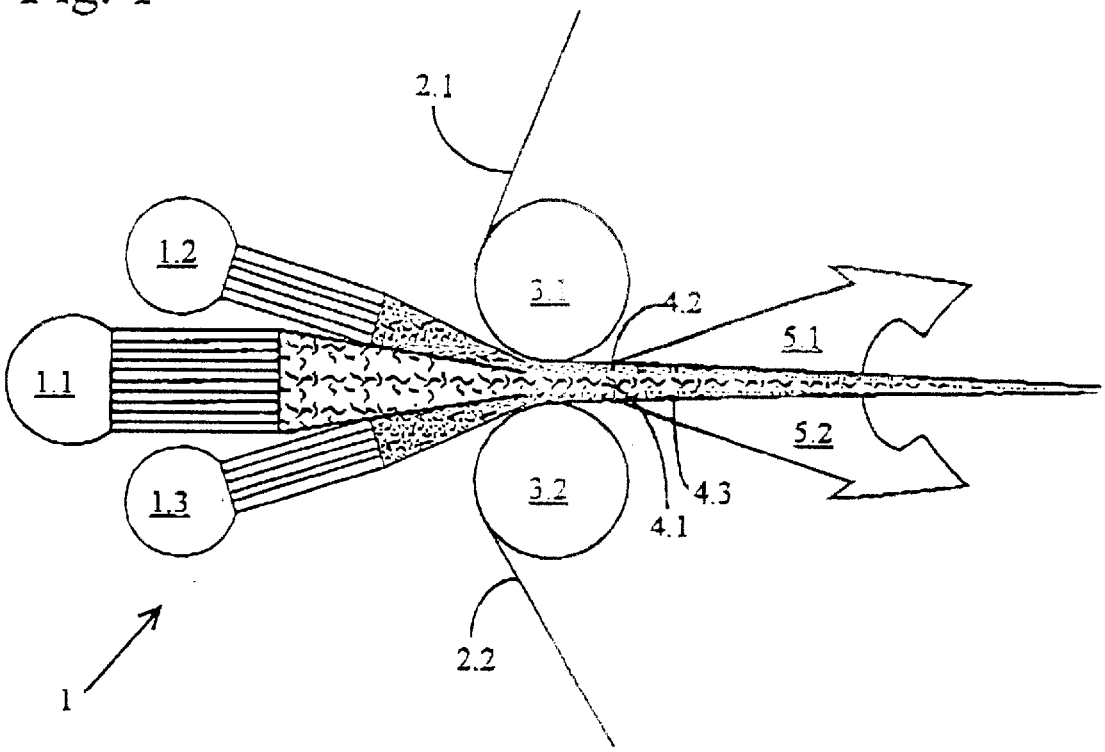
FIG. 1 shows a three-layer headbox.

FIG. 1 shows the manufacturing process according to the invention, with a three-layer headbox 1 and an adjoining twin-wire former. The headbox 1 has three supplies 1.1 to 1.3. with the middle supply 1.1 being loaded with a stock suspension produced according to the invention with a stock that has a beating degree that is greater than or equal to approximately 50 ml CSF.

On the outsides, two additional supplies 1.2 and 1.3 are shown, which are used to deposit a suspension that is essentially loaded with filler against the outsides of the suspension layer being produced, The suspensions are then introduced between the two wires 2.1 and 2.2. The wires 2.1 and 2.2 are conveyed together by way of two rolls 3.1 and 3.2. Then the three-layer stock suspension layer that is formed by way of the headbox 1 is drained through the wires 2.1 and 2.2, which travel in sandwich fashion. The drainage is schematically indicated by the two arrows 5.1 and 5.2. In this manner, an inner fiber layer 4.1 is formed which is produced by a stock suspension having a beating degree of greater than approximately 50 ml CSF. The inner fiber layer 4.1 is encompassed on each of its two outsides by a filler layer 4.2 and 4.3, which provides for a very smooth structure on the surface as is required in gravure paper.

Figure 2:
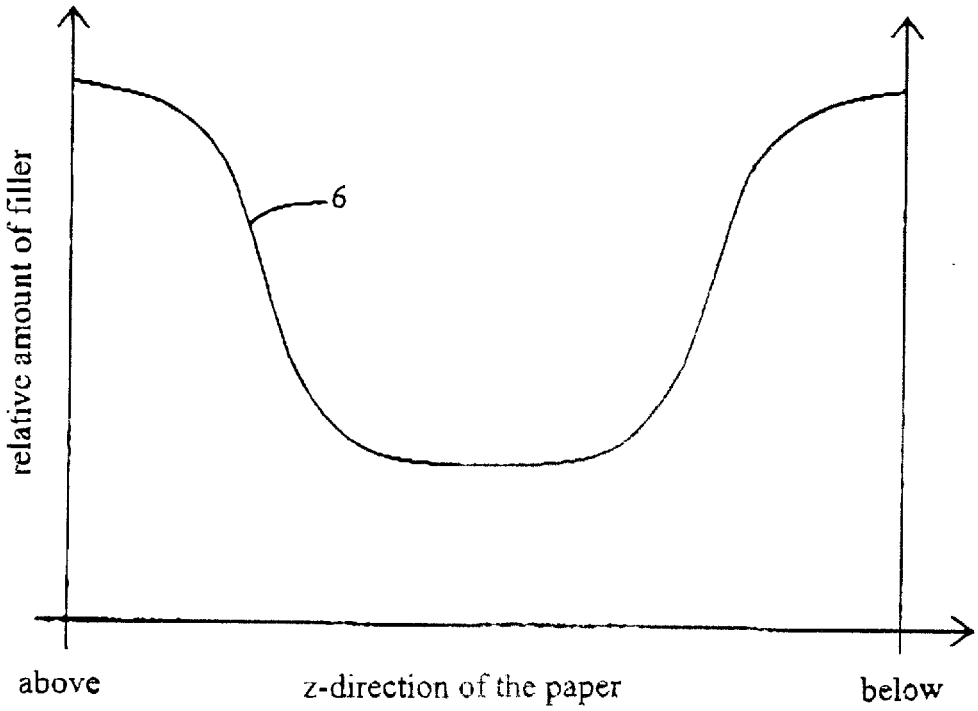
FIG. 2 shows the progression of the relative filer content.

FIG. 2 shows the progression of the relative filler content 6 in a coordinate system in which the relative filler content is plotted on the ordinate and the Z direction (thickness) of the paper is depicted on the abscissa. The two arrows at the edges represent the surfaces of the top (left) and bottom (right) of the finished paper.

In this connection, it should be noted that the filler content 6 achieves a maximum on the top and bottom of the paper while, in the center region of the paper, there is a relatively low filler content. Correspondingly, in this region, the content of fibrous material is high and, according to the invention, has a beating degree with a freeness greater than approximately 50 ml CSF, The high filler content in the outer layers of the paper achieves the optimal printability of the paper for the gravure process, although there is only a reduced beating degree of the stock of the inside paper layer. In addition, an improved runability of the paper is also a positive side effect.

Figure 2A:
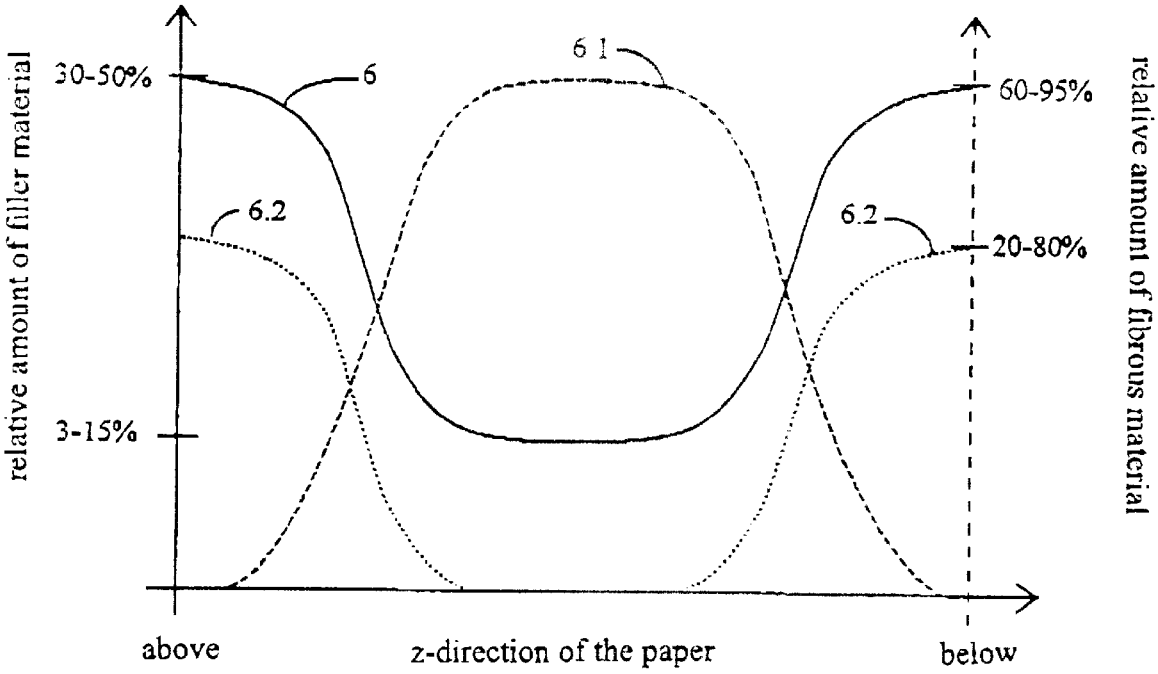
FIG. 2*a* shows the progression of the relative filler content and of the fibrous material contents.

Another possible progression of the relative fiber and filler content is shown in FIG. 2*a*. In this instance, the curve 6 represents the relative filler content over the z direction of the paper, the curve 6.1 represents the progression of the relative fibrous material content from a stock with between approximately 50 to approximately 120 ml CSF, and the curve 6.2 represents the progression of the relative filler content from a stock with approximately <30 ml CSF. It should be noted that, in this case, the outer regions contain almost exclusively filler and fibrous material with <30 ml CSF, while a low filler content and mainly fibrous material content comprised of a stock with between approximately 50 to approximately 120 ml CSF have settled in the inner layer.

Figure 3:
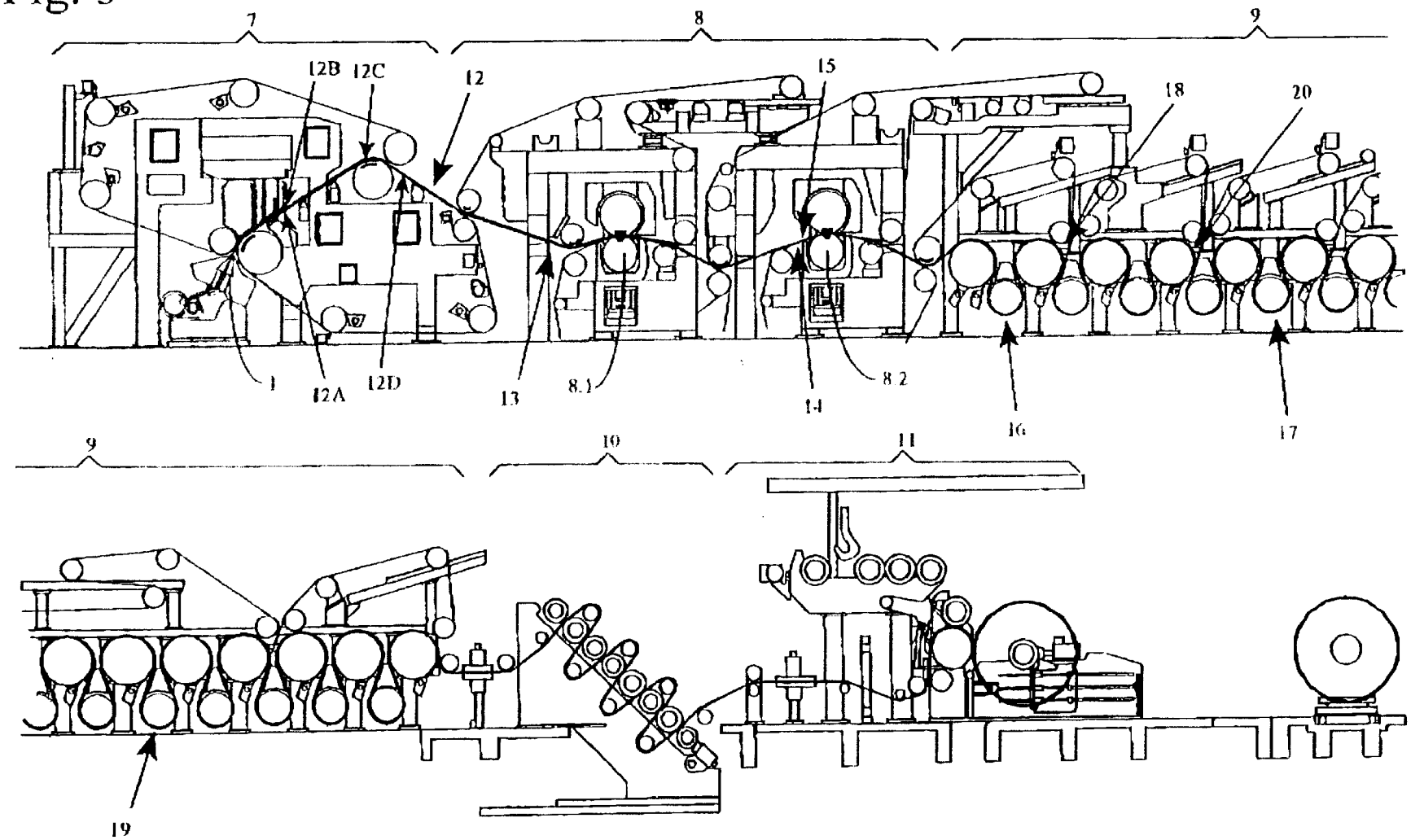
FIG. 3 shows a paper machine with filler and pigment applicators.

FIG. 3 shows a manufacturing process for the gravure paper according to the invention. A paper machine is shown having a forming system 7, including a twin-wire former, which is supplied with stock suspension by way of a single-layer headbox 1. This is followed by a press section 8 with two shoe presses 8.1 and 8.2. Then comes a single-tier drying section 9, which is followed by a calender 10, From there, the finished paper is finally supplied to the winding station 11. By way of example, the arrows 12 to 20 show possible positions for applicators for applying pigment or filler.

A first position for an applicator, i.e., a first application point, is indicated by the arrow 12. This application point is disposed in the vicinity of the transition from the forming system to the press section, i e., in a region in which the top wire has already been removed from the fibrous material web and the fibrous material web is only supported by a bottom wire of the forming system, Other advantageous application points are the positions 12A to 12C in the twin-wire former depicted, with the application taking place through the wires here as well.

After this application point 12, the bottom wire is detached and the fibrous material web is taken over by the first top wire of the press section, with another favorable application point 13 being disposed in this free section of the second side of the fibrous material web. Since the fibrous material web passes through the press 8.1 after the application of the pigment or filler layer, these newly applied layers are optimally "welded" to the fibrous material web.

Two other possible locations for an application through the wire are disposed directly before the second shoe press 8.2. These locations are indicated by the arrows 14 and 15. Pigment and/or filler can be advantageously applied through the wire here since in this region, the fibrous material web is enclosed in sandwich fashion between two wires.

In the subsequent drying section 9, there are three other possible application points 16, 17, and 19. At these application points, each of which is formed by a deflecting roll, there is also the possibility of a direct application onto the fibrous material web disposed in the drying process such that, with the depicted exemplary embodiment of the drying section as a single-tier drying section, only one side of the fibrous material web can be accessed in this way with no trouble. However, there is also a possibility for the application of pigment and filler at the locations in which the respective top belt is lifted up from the paper web to be dried. Unfortunately, space for the application on the opposite side of the fibrous material web is somewhat limited here. Application points of this kind are indicated, for example, by the arrows 18 and 20.

If, in lieu of the single-tier drying section, a dual-tier drying section is used, then conditions are favorable for a similar application on both sides of the paper.

In the application of the pigment and/or filler layer onto the fibrous material web being produced, it is important that the dry matter content of the fibrous material web has not yet exceeded approximately 90% since, with a dry matter content of greater than approximately 90%, the bonding to the fibrous material web is not strong enough. A dry matter content of between approximately 3% to approximately 55% is preferable.

Thus, on the whole, this manufacturing process for a gravure paper achieves a significantly more favorable energy yield, since a stock suspension with a low beating degree is used. In contrast to the high energy costs associated with high quality TMP stock (TMP=Thermomechanical Pulp) of between approximately 2800—approximately 3200 kWh/t and higher, the invention requires less than approximately 2800 kWh/t. Furthermore, subsequent coating operations can be eliminated, thereby producing considerable investment savings through the elimination of a coating machine, Accordingly, the gravure paper which is produced using a process according to the invention, takes advantage of extremely favorable manufacturing costs.

An additional significant advantage is that the filler enrichment of the outer sheet layers contributes to the homogenization of the sheet structure and consequently to an equalizing effect. As a result, a very favorable fiber covering is also achieved.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

| | |
|---|---|
| 1 | headbox |
| 1.1 | supply for fibrous material |
| 1.2 and 1.3 | supply for filler/pigment |
| 2.1 and 2.2 | wire |
| 3.1 and 3.2 | roll |
| 4.1 | fibrous layer |
| 4.2 and 4.3 | filter layer |
| 5.1 and 5.2 | drainage |
| 6 | progression of the relative filler content |
| 7 | forming system |
| 8 | press section |
| 8.1 and 8.2 | shoe press |
| 9 | drying section |
| 10 | calender |
| 11 | winding station |
| 12 to 20 | application points/positions for applicators |

What is claimed is:

1. A method of manufacturing gravure paper having a maximal roughness depth of approximately 1.40 $\mu$m in a paper machine comprising a forming system, a first press section, and a drying section, the method comprising:

producing a stock suspension comprising a stock having a freeness of greater than or equal to approximately 50 ml CSF;

forming an unfinished fibrous material web from the stock suspension; and applying at least one of a pigment and a filler slurry to the unfinished fibrous material web between a beginning of the forming system and a position at which the dry matter content of the unfinished fibrous material web is approximately $\leqq 90\%$, wherein the stock suspension comprises a stock having a freeness of between approximately 50 ml to approximately 120 ml CSF.

2. The method of claim 1, wherein the stock suspension comprises a stock having a freeness of between approximately 50 ml to approximately 80 ml CSF.

3. The method of claim 1, wherein, after the applying of the at least one of the pigment and the filler, no subsequent coating occurs.

4. The method of claim 3, wherein a fibrous material content in at least one of the pigment and the filler slurry is in the range of between approximately 2% to approximately 60%.

5. The method of claim 4, wherein the fibrous material content in the at least one of the pigment and the filler slurry is in the range of between approximately 5% to approximately 30%.

6. The method of claim 1, wherein the gravure paper is manufactured without utilizing coating which does not occur in at least one of the forming system, the press section, and the drying section.

7. The method of claim 1, wherein the applying occurs before the unfinished fibrous material web passes through the press section of the paper machine.

8. The method of claim 7, wherein the applying occurs before the unfinished fibrous material web passes through the press section and the drying section of the paper machine.

9. The method of claim 1, wherein the applying occurs in the forming system of the paper machine.

10. The method of claim 3, wherein the applying occurs when the unfinished fibrous material web has a dry matter content of less than approximately 55%.

11. The method of claim 10, wherein the applying occurs when the dry matter content is between approximately 3% to approximately 55%.

12. The method of claim 1, wherein a total coating weight of at least one application of one of the at least one of the pigment and the filler slurry on one side of the unfinished fibrous material web comprises a moisture-free weight of between approximately 0.5 to approximately 10.0 g/m$^2$.

13. The method of claim 12, wherein the moisture free weight is between approximately 1.0 to approximately 10 g/m$^2$.

14. The method of claim 1, wherein the applying occurs when the unfinished fibrous material web has a dry matter content of less than approximately 55%.

15. The method of claim 14, wherein the applying occurs when the dry matter content is between approximately 3% to approximately 55%.

16. A method of manufacturing gravure paper having a maximal roughness depth of approximately 1.40 $\mu$m in a paper machine comprising a forming system, a first press section, and a drying section, the method comprising:

producing a stock suspension comprising a stock having a freeness of greater than or equal to approximately 50 ml CSF;

forming an unfinished fibrous material web from the stock suspension; and applying at least one of a pigment and a filler slurry to the unfinished fibrous material web between a beginning of the forming system and a position at which the dry matter content of the unfinished fibrous material web is approximately $\leqq 90\%$, wherein the applying further comprises applying at least one of the pigment and the filler on both sides of the unfinished fibrous material web.

17. A method of manufacturing gravure paper having a maximal roughness depth of approximately 1.40 $\mu$m in a paper machine comprising a forming system, a first press section, and a drying section, the method comprising:

producing a stock suspension comprising a stock having a freeness of greater than or equal to approximately 50 ml CSF;

forming an unfinished fibrous material web from the stock suspension; and applying at least one of a pigment and a filler slurry to the unfinished fibrous material web between a beginning of the forming system and a position at which the dry matter content of the unfinished fibrous material web is approximately ≦90%, wherein the applying of the at least one of the pigment and the filler slurry to the unfinished fibrous material web occurs in the press section of the paper machine.

18. A method of manufacturing gravure paper having a maximal roughness depth of approximately 1.40 μm in a paper machine comprising a forming system, a first press section, and a drying section, the method comprising:

producing a stock suspension comprising a stock having a freeness of greater than or equal to approximately 50 ml CSF;

forming an unfinished fibrous material web from the stock suspension; and applying at least one of a pigment and a filler slurry to the unfinished fibrous material web between a beginning of the forming system and a position at which the dry matter content of the unfinished fibrous material web is approximately ≦90%, wherein the applying is performed through a wire.

19. A method of manufacturing gravure paper having a maximal roughness depth of approximately 1.40 μm in a paper machine comprising a forming system having a headbox, a first press section, and a drying section, the method comprising:

producing a stock suspension comprising a stock having a freeness of greater than or equal to approximately 50 ml CSF;

producing a coating suspension comprising at least one of a filler and a pigment, the coating suspension having a fiber content in the range of between approximately 10% to approximately 95%;

forming a fibrous material web comprising at least two layers with the headbox, wherein at least one layer is formed from the coating suspension and another layer is formed from the stock suspension; and forming a paper web by guiding the fibrous material web through the forming system, the first press section, and the drying section.

20. The method of claim 19, wherein the stock suspension comprises a stock having a freeness of between approximately 50 ml to approximately 120 ml CSF.

21. The method of claim 20, wherein the stock suspension comprising a stock having a freeness of between approximately 50 ml to approximately 80 ml CSF.

22. The method of claim 19, wherein the fiber content is in the range of between approximately 20% to approximately 60%.

23. The method of claim 19, wherein the at least one of the pigment and the filler comprises at least one of kaolin, clay, powdered $CaCO_3$, PCC, $TiO_2$, talcum, and bentonite.

24. The method of claim 23, wherein at least one of the pigment and the filler comprises at least one of retention agents, fixing agents, dispersion agents, sizing agents, bonding agents, and fines suspension.

25. The method of claim 19, wherein at least one of the pigment and the filler comprises at least one of retention agents, fixing agents, dispersion agents, sizing agents, bonding agents, and fines suspension.

26. A gravure paper having a maximal surface roughness depth of 1.40 μm which is made in a paper machine comprising a forming system, a first press section, and a drying section by a method comprising:

producing a stock suspension comprising a stock having a freeness of greater than or equal to approximately 50 ml CSF;

forming an unfinished fibrous material web from the stock suspension; and applying at least one of a pigment and a filler slurry to the unfinished fibrous material web between a beginning of the forming system and a position at which the dry matter content of the unfinished fibrous material web is approximately ≦90%, wherein the stock suspension comprises a stock having a freeness of between approximately 50 ml to approximately 120 ml CSF.

27. The gravure paper of claim 26, wherein the stock suspension comprises a stock having a freeness of between approximately 50 ml to approximately 80 ml CSF.

28. The gravure paper of claim 26, wherein, after the applying of the at least one of the pigment and the filler, no subsequent coating occurs.

29. The gravure paper of claim 28, wherein a fibrous material content in the at least one of the pigment and the filler slurry is in the range of between approximately 2% to approximately 60%.

30. The gravure paper of claim 29, wherein the fibrous material content in the at least one of the pigment and the filler slurry is in the range of between approximately 5% to approximately 30%.

31. The gravure paper of claim 26, wherein the gravure paper is manufactured without utilizing coating which does not occur in at least one of the forming system, the press section, and the drying section.

32. The gravure paper of claim 26, wherein the applying occurs before the unfinished fibrous material web passes through the press section of the paper machine.

33. The gravure paper of claim 32, wherein the applying occurs before the unfinished fibrous material web passes through the press section and the drying section of the paper machine.

34. The gravure paper of claim 26, wherein the applying occurs in the forming system of the paper machine.

35. The gravure paper of claim 28, wherein the applying occurs when the unfinished fibrous material web has a dry matter content of less than approximately 55%.

36. The gravure paper of claim 26, wherein a total coating weight of at least one application of one of the at least one of the pigment and the filler slurry on one side of the unfinished fibrous material web comprises a moisture-free weight of between approximately 0.5 to approximately 10.0 $g/m^2$.

37. The gravure paper of claim 36, wherein the moisture-free weight is between approximately 1.0 to approximately 10 $g/m^2$.

38. A gravure paper having a maximal surface roughness depth of 1.40 μm which is made, in a paper machine comprising a forming system, a first press section, and a drying section, by a method comprising:

producing a stock suspension comprising a stock having a freeness of greater than or equal to approximately 50 ml CSF;

forming an unfinished fibrous material web from the stock suspension; and applying at least one of a pigment and a filler slurry to the unfinished fibrous material web between a beginning of the forming system and a position at which the dry matter content of the unfinished fibrous material web is approximately ≦90%, wherein the applying further comprises applying at least one of the pigment and the filler on both sides of the unfinished fibrous material web.

39. A gravure paper having a maximal surface roughness depth of 1.40 μm which is made, in a paper machine comprising a forming system, a first press section, and a drying section, by a method comprising:

producing a stock suspension comprising a stock having a freeness of greater than or equal to approximately 50 ml CSF;

forming an unfinished fibrous material web from the stock suspension; and applying at least one of a pigment and a filler slurry to the unfinished fibrous material web between a beginning of the forming system and a position at which the dry matter content of the unfinished fibrous material web is approximately ≦90%, wherein the applying further comprises simultaneously applying at least one of the pigment and the filler on both sides of the unfinished fibrous material web.

40. A gravure paper having a maximal surface roughness depth of 1.40 μm which is made, in a paper machine comprising a forming system, a first press section, and a drying section, by a method comprising:

producing a stock suspension comprising a stock having a freeness of greater than or equal to approximately 50 ml CSF;

forming an unfinished fibrous material web from the stock suspension; and applying at least one of a pigment and a filler slurry to the unfinished fibrous material web between a beginning of the forming system and a position at which the dry matter content of the unfinished fibrous material web is approximately ≦90%, wherein the applying of the at least one of the pigment and the filler slurry to the unfinished fibrous material web occurs in the press section of the paper machine.

41. A gravure paper having a maximal surface roughness depth of 1.40 μm which is made, in a paper machine comprising a forming system, a first press section, and a drying section, by a method comprising:

producing a stock suspension comprising a stock having a freeness of greater than or equal to approximately 50 ml CSF;

forming an unfinished fibrous material web from the stock suspension; and applying at least one of a pigment and a filler slurry to the unfinished fibrous material web between a beginning of the forming system and a position at which the dry matter content of the unfinished fibrous material web is approximately ≦90%, wherein the applying is performed through a wire.

42. A gravure paper having a maximal surface roughness depth of 1.40 μm which is made in a paper machine comprising a forming system having a headbox, a first press section, and a drying section by a method comprising:

producing a stock suspension comprising a stock having a freeness of greater than or equal to approximately 50 ml CSF;

producing a coating suspension comprising at least one of a filler and a pigment, the coating suspension having a fiber content in the range of between approximately 2% to approximately 60%;

forming a fibrous material web comprising at least two layers with the headbox, wherein at least one layer is formed from the coating suspension and another layer is formed from the stock suspension; and forming a paper web by guiding the fibrous material web through the forming system, the first press section, and the drying section.

43. The gravure paper of claim 42, wherein the stock suspension comprises a stock having a freeness of between approximately 50 ml to approximately 120 ml CSF.

44. The gravure paper of claim 43, wherein the stock suspension comprises a stock having a freeness of between approximately 50 ml to approximately 80 ml CSF.

45. The gravure paper of claim 42, wherein the fiber content is in the range of between approximately 5% to approximately 30%.

46. The gravure paper of claim 42, wherein the at least one of the pigment and the filler comprises at least one of kaolin, clay, powdered $CaCO_3$, PCC, $TiO_2$, talcum, and bentonite.

47. The gravure paper of claim 46, wherein the at least one of the pigment and the filler comprises at least one of retention agents, fixing agents, dispersion agents, sizing agents, bonding agents, and fines suspension.

48. The gravure paper of claim 42, wherein the at least one of the pigment and the filler comprises at least one of retention agents, fixing agents, dispersion agents, sizing agents, bonding agents, and fines suspension.

49. The gravure paper of claim 42, wherein the coating suspension comprises a stock having a freeness degree of approximately ≦30 ml CSF.

50. The gravure paper of claim 49, wherein the freeness degree is approximately ≦20 ml CSF.

51. The gravure paper of claim 42, wherein the fiber content of the coating suspension is between approximately 50% to approximately 100% less than a fiber content of the stock suspension.

* * * * *